United States Patent [19]

Oishi et al.

[11] Patent Number: 4,832,641

[45] Date of Patent: May 23, 1989

[54] STORAGE STRUCTURE OF LIQUID TANK FOR MARINE PROPULSION

[75] Inventors: Hiroshi Oishi; Norihito Mizusawa, both of Hamamatsu, Japan

[73] Assignee: Sanshin Kogyo Kabushiki Kaisha, Hamamatsu, Japan

[21] Appl. No.: 106,859

[22] Filed: Oct. 6, 1987

[30] Foreign Application Priority Data

Oct. 7, 1986 [JP] Japan ..... 61-237250

[51] Int. Cl.[4] ..... B63H 21/26

[52] U.S. Cl. ..... 440/88; 123/195 P

[58] Field of Search ..... 123/195 R, 195 C, 195 P, 123/195 S, 196 R, 198 E; 440/76, 77, 88; 280/5 A, 5 R; 180/69.24, 68.3, 68.1

[56] References Cited

U.S. PATENT DOCUMENTS

| | | | |
|---|---|---|---|
| 2,132,926 | 10/1938 | Best | 180/69.24 |
| 2,159,477 | 5/1939 | Friedman | 180/69.24 |
| 2,549,485 | 4/1951 | Kiekhaefer | 123/195 P |
| 3,610,198 | 10/1971 | Alexandrowicz | 123/195 P |
| 4,234,070 | 3/1988 | Mondek | 440/88 |
| 4,493,661 | 1/1985 | Iwai | 440/88 |
| 4,661,076 | 4/1987 | Iwai | 123/195 P |
| 4,673,360 | 6/1987 | Kojima | 440/88 |
| 4,692,123 | 4/1987 | Tada | 123/195 P |

*Primary Examiner*—Sherman D. Basinger
*Assistant Examiner*—Clifford T. Bartz
*Attorney, Agent, or Firm*—Ernest A. Beutler

[57] ABSTRACT

A number of embodiments of outboard motors incorporating liquid storage tanks within the protective cowling and wherein the cowling includes a removable cowling portion that cooperates with the fill neck for closing the fill neck when the removable cowling portion is in place. In some embodiments, the fill neck is accessible by a pivoted closure member which seals the fill neck and which defines an air inlet opening to the cowling. In other embodiments, the tank has a bellows-type expandable fill neck that pops up when the fill neck is accessed.

12 Claims, 4 Drawing Sheets

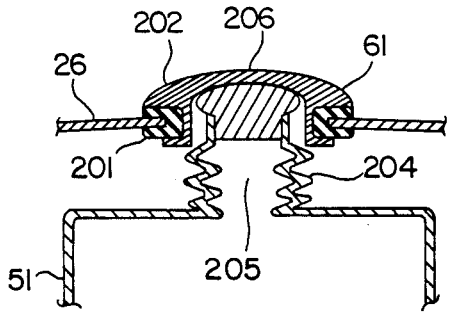
FIG. 5
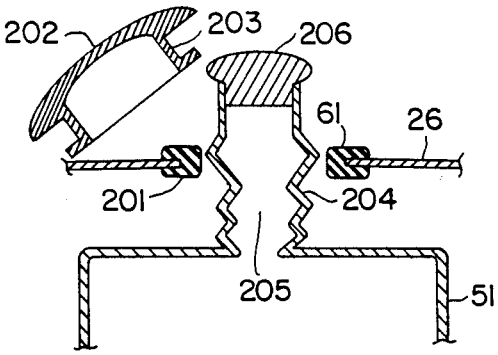
FIG. 6
FIG. 7
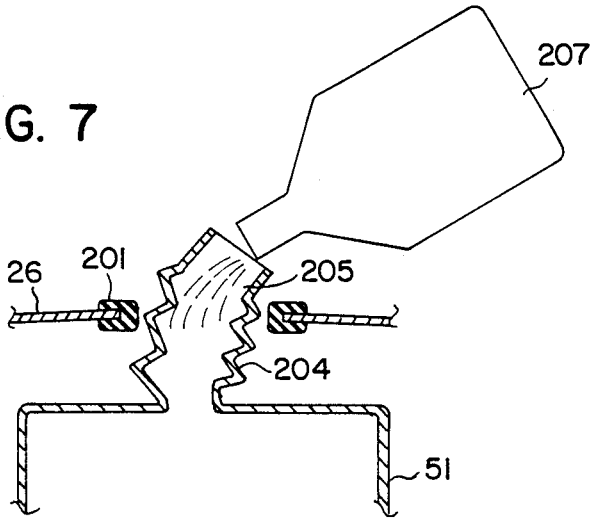

STORAGE STRUCTURE OF LIQUID TANK FOR MARINE PROPULSION

BACKGROUND OF THE INVENTION

This invention relates to a storage structure for a liquid tank for a marine propulsion unit and, more particularly, to an improved storage tank and closure arrangement therefor for the powerhead of an outboard motor.

It is well known in outboard motors to provide a liquid storage tank that is contained within the outer protective cowling of the powerhead of the motor. Such tanks may be used to contain a supply of lubricant for the engine lubricating system. Although such a location for the liquid storage tank has many advantages, it does give rise to certain problems. For example, it is necessary to insure that the storage tank and, particularly, its fill opening may be readily accessible for ease of filling. This is particularly important when it must be remembered that often times the liquid must be replenished when the motor is attached to a watercraft and the watercraft is in a body of water.

In U.S. Pat. No. 4,673,360 entitled "Built-In Tank Containing Lubricant or the like For Outboard Motors", issued on June 16, 1987, in the name of Akinori Kojima and assigned to the assignee of this application, there is disclosed a very convenient arrangement for such a liquid storage tank and its filling. However, the arrangement shown in that patent does present some difficulties in filling. As is well known, the protective cowling of an outboard motor is provided so as to enclose the engine and protect it from the elements during operation. However, there are times when the protective cowling must be removed and the arrangement shown in that patent can present certain problems in connection with the removal of protective cowling. Furthermore, it may be desirable to provide access to the liquid storage tank fill opening merely by removal of the protective cowling.

It is, therefore, a principal object of this invention to provide an improved liquid storage tank for an outboard motor.

It is a further object of this invention to provide an improved liquid storage tank and closure arrangement for an outboard motor.

it is yet a further object of this invention to provide an improved liquid storage tank and closure arrangement for an outboard motor wherein the liquid storage tank fill opening may be conveniently accessed upon removal of the protective cowling.

SUMMARY OF THE INVENTION

This invention is adapted to be embodied in an outboard motor having a powerhead that is comprised of an internal combustion engine and a surrounding protective cowling. A liquid storage tank is supported within the protective cowling and has a filler neck defining a fill opening. A closure is provided for the filler neck and which is carried by a removable portion of the protective cowling and which sealingly engages the filler neck when the removable portion is affixed to the remainder of the protective cowling and which permits access to the filler neck when the removable cowling portion is removed from the remainder of the protective cowling. An openable closure member is carried by the removable cowling portion for selective access to the filler neck when the removable cowling portion is affixed to the remainder of the cowling.

BRIEF DESCRIPTION OF THE DRAWINGS

FIG. 5 is a partial cross-sectional view showing another embodiment of the invention with the closure for the fill neck in place.

FIG. 6 is a cross-sectional view, in part, similar to FIG. 5, showing the closure member of the protective cowling removed.

FIG. 7 is a cross-sectional view, in part, similar to FIGS. 5 and 6, showing the fill neck accessed for filling.

DETAILED DESCRIPTION OF THE PREFERRED EMBODIMENTS

Figure 1:
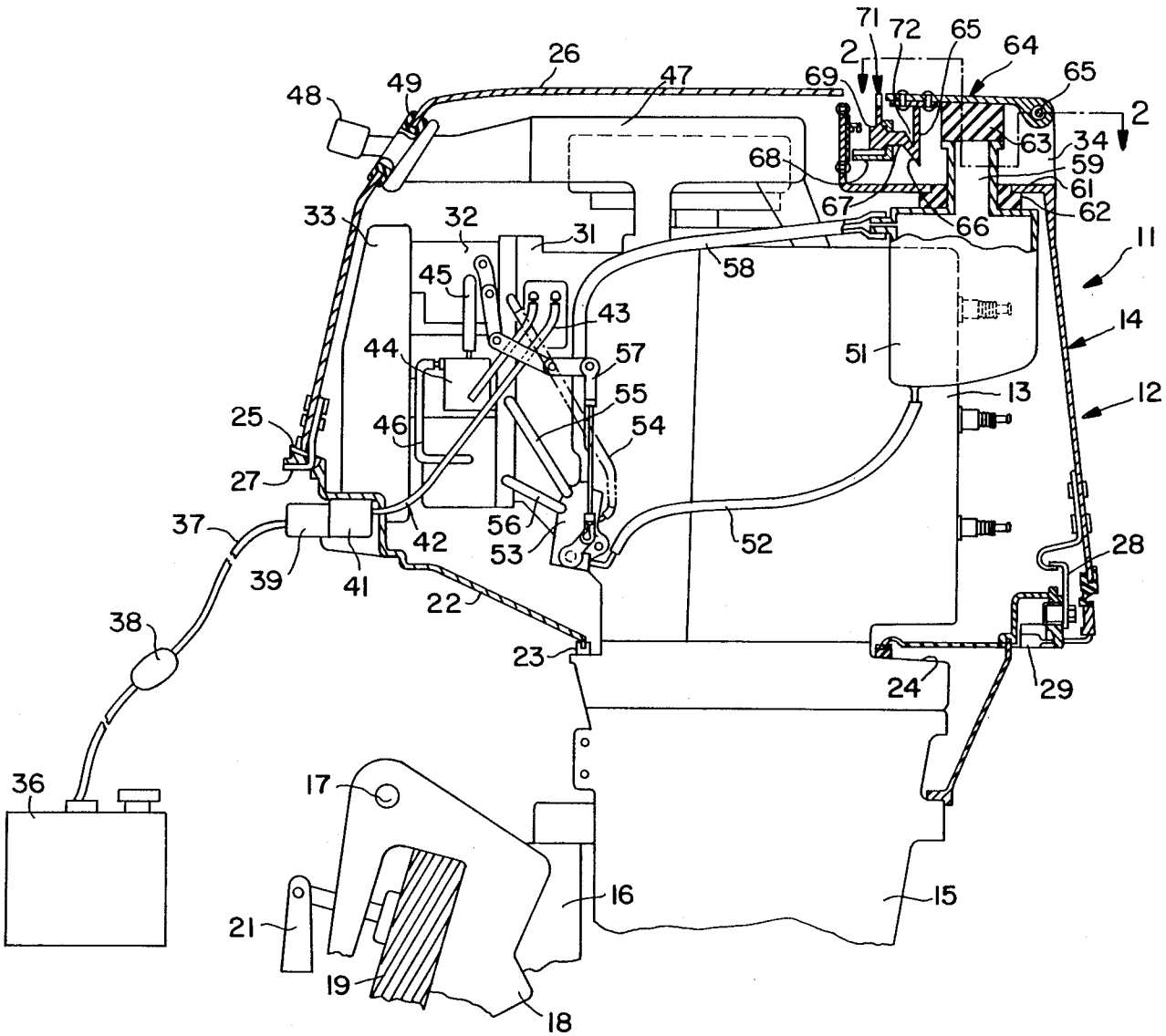
FIG. 1 is a side-elevational view of a portion of an outboard motor constructed in accordance with an embodiment of the invention, with portions broken away.
Figure 2:
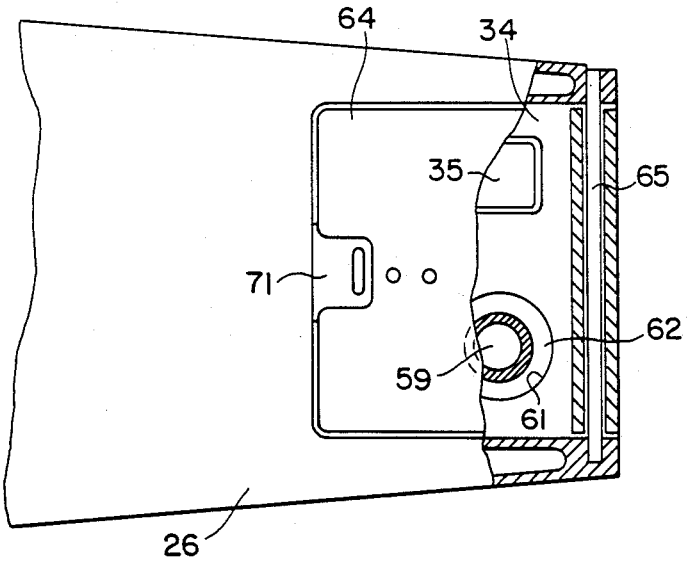
FIG. 2 is a view looking in the direction of the line 2—2 of FIG. 1.

Referring first to the embodiments of FIGS. 1 and 2, a portion of an outboard motor constructed in accordance with this embodiment is identified generally by the reference numeral 11. The outboard motor 11 includes a powerhead assembly, indicated generally by the reference numeral 12 which is comprised of an internal combustion engine 13 and a surrounding protective cowling, indicated generally by the reference numeral 14. Depending from the powerhead 12 is a driveshaft housing 15 that contains a driveshaft (not shown) that is driven by the engine 13 in a known manner. Since the invention relates to the construction of a powerhead assembly 12 and, specifically, components that are contained within the protective cowling 14 and the relationship of the protective cowling 14 to these components, the lower unit of the outboard motor is not depicted nor are the details of the drive for the propulsion unit carried within the lower unit.

As is conventional practice, the outboard motor 15 includes a steering shaft (not shown) that is journaled for steering movement within a swivel bracket assembly 16. The swivel bracket 16 is, in turn, pivotably connected by means of a pivot pin 17 to a clamping bracket 18 for tilting and trim movement of the outboard motor 11 relative to an associated transom 19 of a watercraft. The clamping bracket 18 carries a clamping device 21 for affixing the outboard motor 11 to the transom 19.

The protective cowling assembly 14 includes a tray portion 22 that is affixed in a suitable manner to the engine 13 and which defines a central opening in which a seal 23 is supported for sealingly engaging a flange 24 formed on the upper portion of the driveshaft housing 15. The tray portion 22 has an outer peripheral edge that is engaged by a seal 25 of a removable top cowling portion 26. The cowling portion 26 is affixed to the tray 22 by means of a front retaining hook 27 and a rear releasable latch 28. The latch 28 has an accessible operator 29 so as to permit release of the latch 28 so that the top cowling portion 26 may be conveniently removed.

The engine 13 may be of any known type and is depicted as being a three-cylinder, in-line, crankcase compression, two-cycle engine. It is, therefore, provided with an induction system that includes a manifold 31 that receives a fuel/air charge from a plurality of carburetors 32. This fuel/air charge is delivered is a known manner to individual sealed crankcase chambers of the engine 13. An air inlet device 33 is affixed to the carburetors 32 for providing silenced intake air to the carburetors 32. This air is drawn from within the protective cowling 14. Atmospheric air is delivered to the interior of the protective cowling 14 through a rearwardly facing air inlet opening 34. The air flows from the inlet opening 34 downwardly into the protective cowling 14 through a vertically extending air passage 35 that is formed in the cowling portion Fuel is supplied to the carburetors 32 from a remotely positioned fuel tank 36 that may conveniently be carried within the hull of the watercraft. A conduit 37 in which is priming pump 38 is located is provided for delivering fuel from the tank 36 to a quick disconnect coupling member 39. The coupling member 39 cooperates with a mating coupling member 41 that is carried by the tray 22 and which, in turn, supplies a conduit 42 that is contained within the power head 12 and specifically within the protective cowling 14. The conduit 42 supplies fuel to a fuel filter 43. From the fuel filter 43, fuel is delivered to a fuel pump 44 which is driven by the engine 13 in a suitable manner. For example, the fuel pump 44 may be operated by the pressure variations within the crankcase chambers of the engine. This fuel is then delivered to the carburetors 32 by conduits 45 and 46.

The engine 13 is provided with a pull starter mechanism which includes an outer housing 47 in which a starter rope is contained. A starting handle 48 is affixed to the outer end of the starter rope and the handle 48 is exposed through an opening 49 in the top cowling portion 26 at its forward edge.

The engine 13 is provided with a separate lubricating system that includes a lubricant storage tank 51 that is fixed to the engine 13 and supported thereby within the protective cowling 14. A delivery conduit 52 extends from the lubricant storage tank 51 to a lubricating pump 53 that is driven in an appropriate manner by the engine 13. Lubricant is delivered by the lubricant pump 53 to the intake manifold 31 through respective conduits 54, 55 and 56 for mixing with the air/fuel flow therethrough for lubricating the engine. The manner in which the engine is lubricating may also include also lubricant conduits that extend directly to certain mechanical components of the engine for their lubrication. The quantity of lubricant supplied by the pump 53 is controlled by a mechanism including a throttle operated linkage system 57 so as to provide the appropriate degree of lubrication. In addition, a vent passage 58 extends from an upper portion of the lubricant pump 53 back to the lubricant storage tank 51 for venting air from the system.

In order to replenish the lubricant in the lubricant storage tank 51, the tank 51 is provided with a fill neck 59 that extends through an opening 61 in the protective cowling cover piece 26. An annular gasket 62 is bonded to the tank 51 and provides a seal between the fill neck 59, opening 61 and the upper portion of the lubricant tank 51.

The fill neck 59 is normally closed when the cowling piece 26 is attached by means of an annular gasket 63 that is affixed to a closure member, indicated generally by the reference numeral 64. The closure member 64 is pivotably supported across the rear end of the cowling piece 26 by means of a pivot pin 65. The closure 64 forms, therefore, the upper periphery of the air entry opening 34. This opening also provides access for an operator's fingers so as to form a hand grip by which the outboard motor 11 may be tilted up. Because the hinge pin 65 extends across this area, it will act as a reenforcement for such lifting of the outboard motor.

The closure member 64 carries a latching member 65 at its forward end which is has a hook portion 66. A sliding latch member 67 is carried by the cowling piece 26 on a supporting bracket 68 and is normally urged into engagement with a hook-like portion 66 by a compression spring 69. As a result, the closure member 64 will be held in its closed position. Release is possible by means of an upstanding operating portion 71 by which the operator may slide the latching member 67 to a release position so that the closure member 64 may be pivoted upwardly to access the fill neck 59. The latch member 67 has an inclined upper surface 72 that is engaged by the hook portion 66 upon reclosure of the closure member 64 so as to relatch it in a closed position.

It should be readily apparent that the fill neck 59 may be accessed by opening the closure member 64 in the manner previously described. In addition, removal of the cowling piece 26 will also permit access to the fill neck 59.

Figure 3:
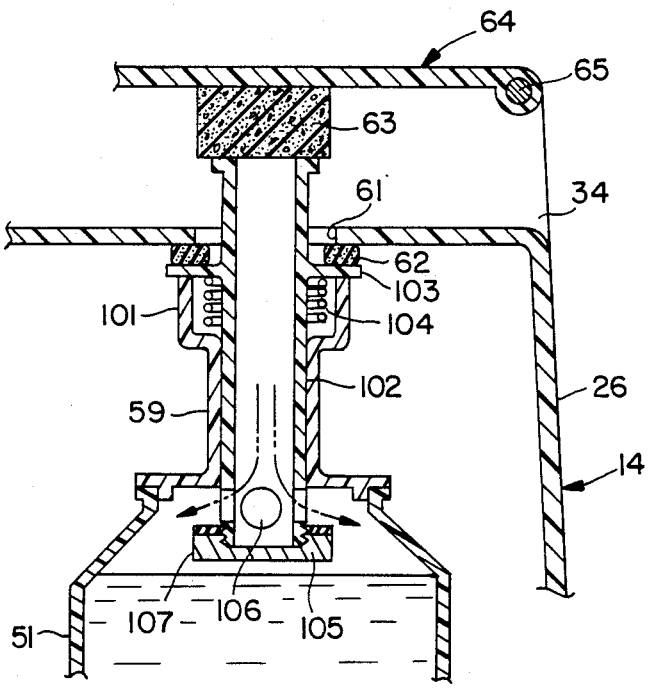
FIG. 3 is a partial cross-sectional view, in part similar to FIG. 1, showing another embodiment of the invention.

As has been noted, the embodiment of FIGS. 1 and 2 is constructed in such a manner that the fill neck 59 will be accessed when the upper cowling piece 26 is removed. However, since the fill neck 59 is not provided with a separate closure member, it will be open at all times when the cowling piece 26 is removed. In some instances, this is not desirable and FIG. 3 shows an embodiment wherein the fill neck 59 will be closed automatically when the cowling piece 26 is removed. However, there is not a separate closure member which must be removed each time it is desired to replenish the tank in accordance with this embodiment. Referring now specifically to FIG. 3, it should be noted that the fill neck 59 has an enlarged upper portion 101 and slidably supports a sleeve 102. The sleeve 102 has an enlarged flange 103 formed between the ends of the sleeve 102. The flange 103 is engaged by a coil compression spring 104 that is received in the fill neck enlargement 101. The seal 62 is engaged by this flange 103 and is normally held in sealing engagement with the upper cowling piece 26 by the spring 104.

It should be noted that the lower end of the sleeve 101 is provided with a cap 105 that closes off the lower end of the sleeve 102. Radially extending passages 106 are formed above the cap 105 and permit flow of liquid into the tank 51 when the closure member 64 is opened. A sealing gasket 107 encircles the cap 105 and lies below the opening 106.

When the cowling piece 26 is removed, the seal 63 will move away from the upper end of the sleeve 102 and, as in the previous embodiment, the fill neck would be opened. However, when the cowling piece 26 is removed, the spring 104 can urge the flange 103 upwardly since the gaskets 62 will no longer be constrained by the cowling piece 26. This upward movement continues until the seal 107 engages the underside of the upper end of the tank 51 and the openings 106 will then be sealed. Hence, liquid cannot flow from or to the tank 51. If an operator wishes to add fluid under this condition, he may merely urge the sleeve 102 downwardly against the action of the spring 104 so as to permit the openings 106 to communicate with the interior of the tank 51. However, inadvertent leakage under this condition will be precluded.

Figure 4:
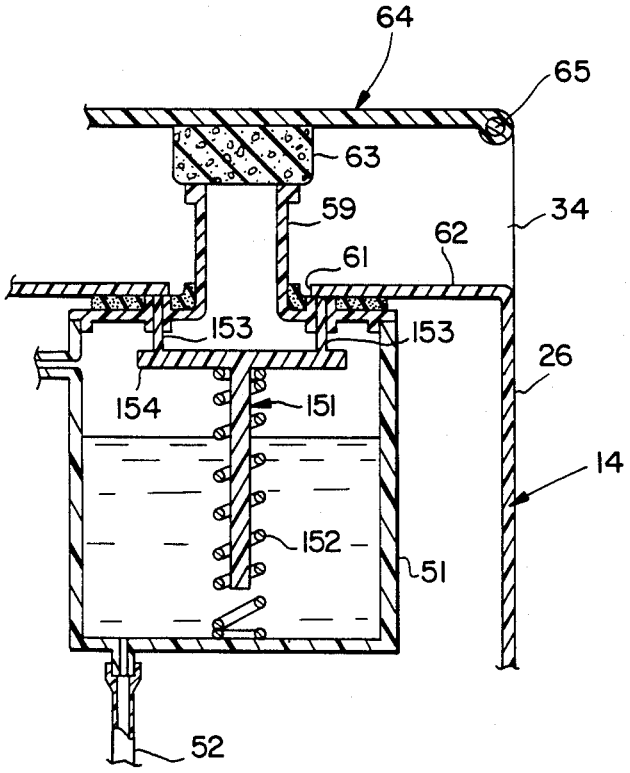
FIG. 4 is a further partial cross-sectional view, in part, similar to FIGS. 1 and 3, showing yet another embodiment of the invention.

FIG. 4 shows another embodiment of the invention that has advantages similar to the embodiment of FIG. 3, however, a different type of sealing arrangement is incorporated for effecting sealing when the cowling piece 26 is removed. In other regards, this embodiment is similar to the previously described embodiments and those components which are the same as those previously described have been identified by the same reference numerals and will not be described again except insofar as necessary to understand the construction and operation of this embodiment.

Referring now to FIG. 4, the fill neck 59 is fixed and itself is directly sealingly engaged by the gasket 63 when the closure member 64 is closed. In this embodiment, a valving member, indicated generally by the reference numeral 151 is supported within the upper end of the tank 51 and is normally urged in an upward direction by means of a coil compression spring 152. Fingers 153, which may be of any suitable number, such as 3, are circumferentially spaced and extend upwardly from a disk-shaped portion 154 of the member 151 into engagement with the cowling piece 26 around its opening 61. The gasket 62 is formed with suitable openings so as to pass these fingers 153. Under this condition, the disk-shaped piece 154 is spaced downwardly from the lower end of the fill neck 59 and liquid may be poured into the interior tank 51 when the closure member 64 is pivoted to an opened position.

If the cowling piece 26 is removed in this embodiment, the spring 152 will urge the member 151 upwardly since the fingers 153 are free of their engagement with the cowling piece 26 and are permitted to move upwardly. The disk-shaped portion 154 will then engage the lower portion of the fill neck 159 and preclude leakage. If desired, a suitable gasket (not shown) may be carried by the member 151 so as to assist in sealing under this condition.

FIGS. 5 through 7 show another embodiment of the invention. In this embodiment, the opening 61 of the cowling piece 26 carries an annular seal 201. The seal 201 is adapted to support a closure cap 202 that is formed with a circumferential groove 203 for snap fitting of the closure member 202 onto the cowling piece 26. In this embodiment, the tank 51 is provided with a bellows-type fill neck 204 and to this end the tank 151 may be formed from a plastic material. The fill neck 204 has a filling opening 205 that is normally closed by means of a snap-in plug 206. The elasticity of the bellows fill neck 204 causes a compression to be exerted on the fill neck 204 when the closure 202 is in place as shown in FIG. 5. However, when an operator desires to fill a tank 51, the closure 202 is removed and the fill neck 204 will pop up (FIG. 6). The plug 206 may then be removed and the lubricant replenished from a supply 207 (FIG. 7). Therefore, there will be an extended fill neck in this embodiment which facilitates filling.

Figure 8:
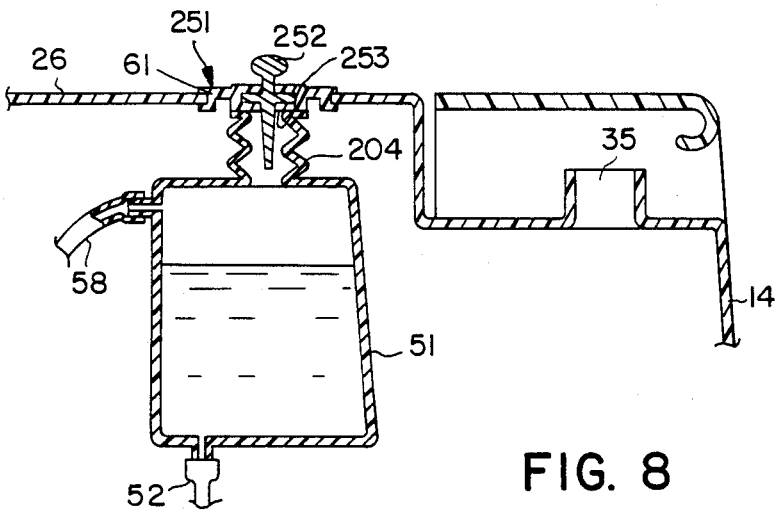
FIG. 8 is a cross-sectional view, in part, similar to FIGS. 5 through 7, and shows yet another embodiment of the invention.

FIG. 8 shows yet another embodiment of the invention wherein the separate plug is eliminated. In this embodiment, a closure plug 251 has an annular portion that snaps into the opening 61 of the cowling piece 26. If desired, an annular gasket (not shown) may be incorporated in this embodiment. The closure 251 is provided with a knob portion 252 that can be accessed by the operator for facilitating removal. The closure 251 also carries an annular gasket 253 that engages the fill neck 254 so as to compress it when the closure 251 is in place and also so as to effect sealing. As a result, a separate closure plug is not required in this embodiment.

It should be readily apparent from the foregoing description that a number of embodiments in the invention have been illustrated and described each of which permits ease of access to the fill opening and also which will cooperate so as to permit filling when one of the cowlings is removed. Although a number of embodiments of the invention have been illustrated and described, various changes and modifications can be made without departing from the spirit and scope of the invention, as defined by the appended claims.

We claim:

1. In an outboard motor having a powerhead comprised of an internal combustion engine and a surrounding protective cowling comprised of a first portion fixed relative to said engine and a removable cowling portion detachably affixed to said first cowling portion, the improvement comprising a liquid storage tank supported within said protective cowling and having a fill neck, and a closure for said fill neck movably carried by said removable cowling portion and sealingly engaging said fill neck when said removable cowling portion is affixed to the remainder of said protective cowling and when said closure is in a closed position, said closure being moveable to an opened position for accessing said fill neck when said removable cowling portion is fixed relative to said first portion of said protective cowling, and means for sealing said fill neck when said removable cowl portion and said closure are removed from the remainder of said protective cowling.

2. In an outboard motor as set forth in claim 1 wherein the closure is pivotably supported between an open and closed position by the removable cowling portion.

3. In an outboard motor as set forth in claim 1 wherein the closure is removably attached to the removable cowling portion.

4. In an outboard motor as set forth in claim 1 wherein the fill neck has partial portion that is adapted to extend when the closure is opened.

5. In an outboard motor as set forth in claim 1 wherein the fill neck includes a slidably supported member carrying a seal at its lower end adapted to sealingly close said fill neck when the removable protective cowling portion is removed and further including biasing means for urging said slidable portion in a direction wherein said seal will be effected.

6. In an outboard motor as set forth in claim 5 wherein the slidable portion is normally engaged by the removable cowling portion when attached to the remaining cowling portion for holding the slidable member in an open position.

7. In an outboard motor as set forth in claim 1 wherein the cowling defines an air inlet opening for induction air to the engine and the closure forms a portion of said air inlet opening.

8. In an outboard motor as set forth in claim 7 further including a second air inlet opening in the protective cowling for delivering air from the air inlet opening to the engine, said second opening being normally enclosed by said closure.

9. In an outboard motor as set forth in claim 8 wherein the closure is pivotably supported by a hinge.

10. In an outboard motor as set forth in claim 9 wherein the hinge is formed by a pin affixed to the closure and reenforcing the closure for handgripping thereof to tilt the outboard motor to a raised position.

11. In an outboard motor as set forth in claim 10 wherein the reenforcing member extends transversely across the upper edge of the air inlet opening.

12. In an outboard motor having a powerhead comprised of an internal combustion engine and a surrounding protective cowling, the improvement comprising a liquid storage tank supported within said protective cowling and having a fill neck, and a closure for said fill neck carried by a removable portion of said protective cowling and sealingly engaging said fill neck when said removable portion is affixed to the remainder of said protective cowling and for accessing said fill neck when said removable cowling portion is removed from the remainder of said protective cowling, and an openable closure member carried by said removable cowling portion for selective access to said fill neck when said removable cowling portion is affixed to the remainder of said protective cowling, said fill neck comprising an integral bellows portion adapted to extend when the openable closure member is opened.

* * * * *